United States Patent [19]

Creely

[11] 4,074,251

[45] Feb. 14, 1978

[54] APPOINTMENT REMINDERS

[76] Inventor: William G. Creely, 1400 E. Duschesne, Florissant, Mo. 63031

[21] Appl. No.: 682,716

[22] Filed: May 3, 1976

[51] Int. Cl.[2] ..... G08B 7/00

[52] U.S. Cl. ..... 340/309.4; 340/286 R; 340/309.1

[58] Field of Search ..... 340/309.1, 309.4, 309.3, 340/283, 279, 321, 323, 322, 332, 311; 40/132 D, 106.1; 240/6.4 R, 6.4 B; 58/19 R, 148

[56] References Cited

U.S. PATENT DOCUMENTS

| | | | |
|---|---|---|---|
| 3,824,723 | 7/1974 | Gargas | 40/132 D X |
| 3,855,588 | 12/1974 | Buckland et al. | 340/309.1 X |
| 3,925,779 | 12/1975 | Gerstenhaber | 340/321 X |

*Primary Examiner*—Harold I. Pitts

[57] ABSTRACT

An appointment reminder device which provides facilities to preset a plurality of independent appointment times and messages with visual and audio indicating means reacting at the preset times comprising cabinet means containing a plurality of message storage areas, a plurality of time selection and indicating means, a plurality of activating means, and a plurality of visual and audio indicating means.

1 Claim, 7 Drawing Figures

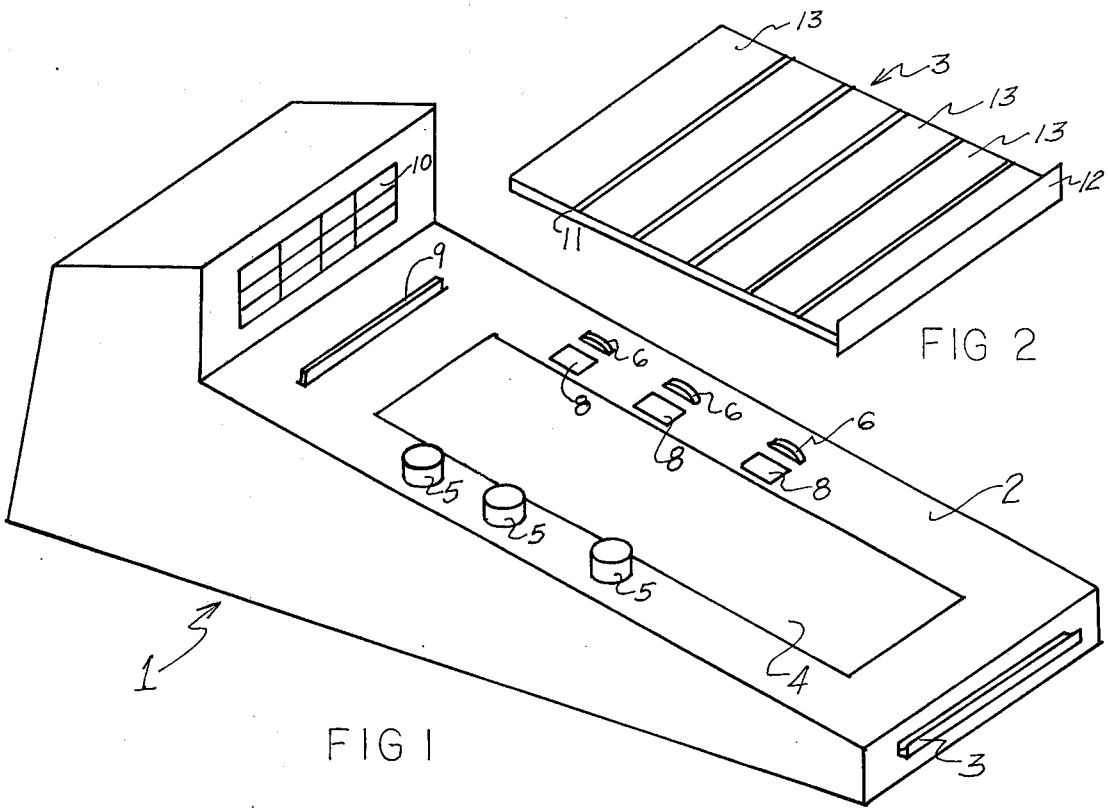
FIG 2
FIG 1
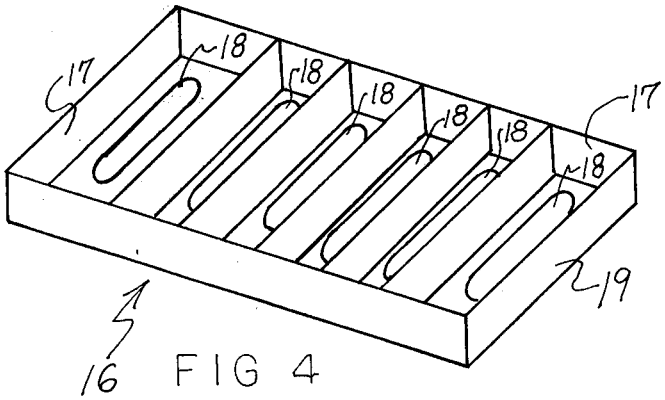
FIG 4
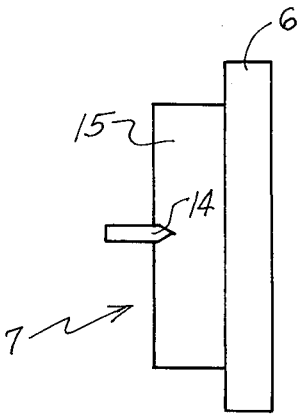
FIG 3

APPOINTMENT REMINDERS

BACKGROUND OF THE INVENTION

Although not by way of limitation it is contemplated that the device described herein will be used such that the user may preselect a plurality of messages to be reminded of at preselected times during the day.

SUMMARY OF THE INVENTION

In the present invention a device is contemplated which includes storage means to accommodate the entry of a plurality of messages to be delivered to the user at subsequent times during the day. Associated with each message is a time selection and indicating control which allows the user to preselect the time of delivery of the associated message. Associated with each message is an activation control which establishes a particular message as having been preset and further engages audio and visual indicating means with the particular message and gives an audio and visual signal when the appropriate times occurs. Means are also provided whereby the user can display all stored messages.

It is therefore an object of the present invention to provide such a device which is simple and economical to manufacture.

A further object of the present invention is to provide such a device which may be constructed pocket-sized and combine the above objects with provisions for a clock, calendar, and radio receiver and transmitter message means.

With the above primary and other incidental objects in view, which will appear more fully in the specification of the invention which is provided herein, the invention to be protected by Letters Patent consists of the features of construction, the parts and combinations thereof, and the mode of operation, hereinafter described or illustrated in the accompanying drawings or their equivalents.

BRIEF DESCRIPTION OF THE DRAWINGS

Referring to the drawings wherein is illustrated a preferred but not necessarily only form of embodiment of the invention.

FIG. 1 is a perspective view of an appointment reminder constructed in accordance with and embodying the present invention.

FIG. 2 is a perspective view message storage tray for use in the device shown in FIG. 1.

FIG. 3 is an elevation view of a time selection and indicating wheel for use in the device shown in FIG. 1.

FIG. 4 is a perspective view of lighting means for use in the device shown in FIG. 1.

DETAILED DESCRIPTION OF THE INVENTION

Figure 5:
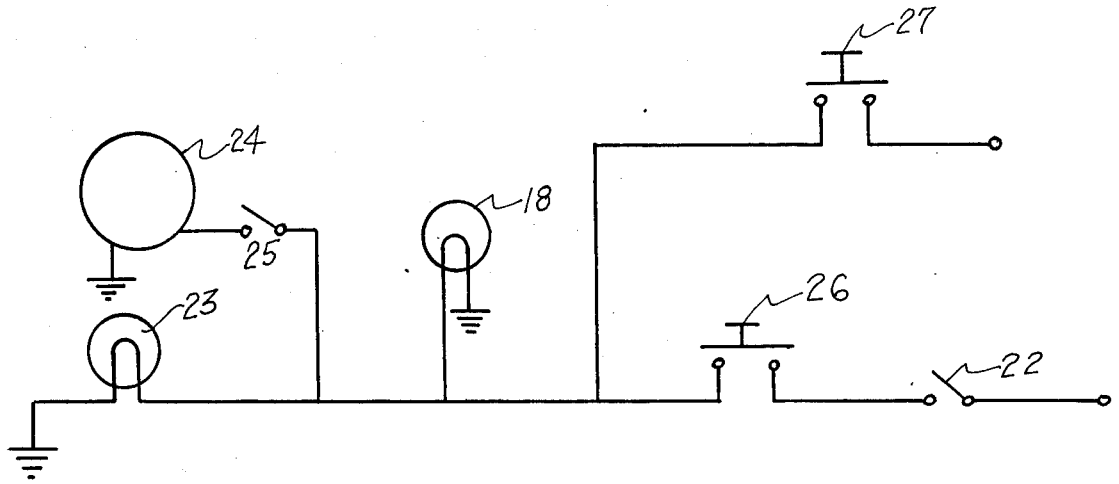
FIG. 5 is a circuit diagram of the device shown in FIG. 1.

Referring now to the drawings in more detail and in particular to FIG. 1, reminder, 1, is seen to comprise primarily cabinet, 2, message tray, 3, viewing window, 4, preferably constructed of tinted glass, on-off controls, 5, time selection wheels, 6, which are mounted on time selection controls, 7, shown in FIG. 3, viewing ports, 8, light bar, 9, and clock means, 10.

In FIG. 1, button controls, 5, are preferably constructed of transparent plastic allowing light from the associated lamp, 23, to illuminate control button, 5, when engaged.

As shown in FIG. 2, message tray, 3, consists of sheet, 11, and edge, 12. Sheet, 11, is divided into a plurality of message areas, 13, corresponding to the message capacity of the device. Sheet, 11, is translucent to the extent necessary to allow light from the light sources in the lighting means, 16, to display the message written on sheet, 11, through the tinted glass in viewing window, 4.

FIG. 3 illustrates the time selection control, 7, in one form. In FIG. 3 the selection wheel, 6, is rotated until the indicator, 14, is indicating the desired time on indicator wheel, 15.

FIG. 4 illustrates the lighting means, 16, as comprising a plurality of light sources, 18, disposed in highly reflective chambers, 17, in frame 19.

Certain features now depicted in FIGS. 1 through 4, are better visualized as shown in the circuit diagram of FIG. 5.

Shown in FIG. 5, are the circuit elements including switch, 22, which is activated by button, 5, and lamp, 23, which illuminates button, 5. Switch, 26, is activated by control, 7. A thermal switch, 25, is provided in the audio indicator, 24, circuit to provide a cycling audio signal. Override switches, 27, are provided which are closed when light bar, 9, is depressed and thereby supply power from source, 27, to all lights, 18, simultaneously.

FIG. 5 represents a circuit configuration which is associated with each message. For a device having a 6 message capacity there would be 6 message spaces, 13, 6 light sources, 18, six button controls, 5, 6 wheels, 6, and 6 of the circuits shown in FIG. 5.

In operation the device is used by first marking the desired message or messages in segments, 13. The desired times with each message is then set on the associated control, 7, using the appropriate wheel, 6, which leaves switch, 26, open until the desired time is reached at which time switch, 26, will close. Each particular message slot is activated by pushing button, 5, thereby closing switch 22. As the device reaches the present time, switch 26, closes providing power to light, 18, audio device, 24, and light, 23, which illuminates lighting area, 21, on control, 5. Switches, 27, and light bar, 9, allow the user to examine all messages at any time to see what is stored.

Figure 6:
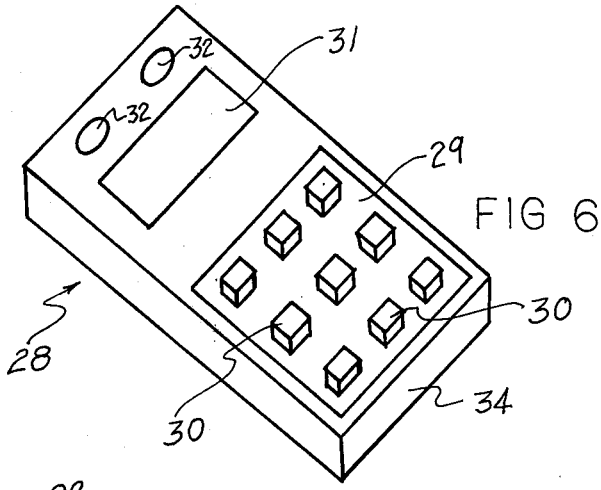
FIG. 6 is a perspective view of another embodiment reminder constructed in accordance with and embodying the present invention.
Figure 7:
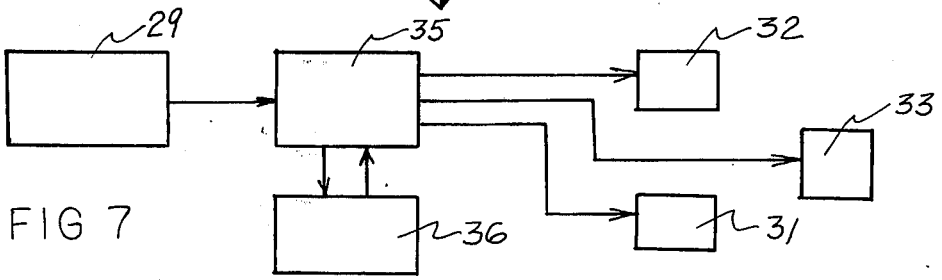
FIG. 7 is a block diagram of the device in FIG. 6.

Another embodiment of the invention herein is described and shown in FIGS. 6 and 7. As shown in FIG. 6, the device 28, comprises housing, 34, in and upon which is mounted keyboard, 29, with keys, 30, message display, 31, buzzer, 32, and light, 33. Not shown in FIG. 6 but shown in FIG. 7, in Input/Output unit, 35, and data storage, 36.

As is readily apparent, device, 28, is a digital device and the components are relatively conventional at this time. In the operation of device, 28, the alarm time and message is entered into the device by means of keyboard, 29. This information is processed into data storage means, 36, by input/output unit, 35. A real-time timer is provided in input/output unit, 35, and at the time selected and set by the original input the stored message is extracted from data storage, 36, and appropriate signals are sent to the light, 33, buzzer, 32, and message display, 31, to activate same. Input/output unit, 35, and, 36, are conventional digital devices. Message display means, 31, may be of the electroluminescent display type or the oscilloscope type and thus be essentially entirely digital or may be simply a combination of manual and automatic means such as a rotatable drum with the particular message to be recalled marked on the drum, written on the drum or provided with removable message strips. The messages are imposed on the drum at selected positions. At the appropriate time the drum will be rotated to the position associated with that particular message and the message will be illuminated and the alarm light and buzzer will be activated.

While I have illustrated and described the preferred embodiments of my invention, it is to be understood that changes and modifications in the form, construction, arrangement and combination of the parts and steps of the appointment reminder may be substituted for those herein shown and described without departing from the nature and principle of my invention.

Having thus described my invention, what I claim as new and desire to secure by U.S. Letters Patent is:

1. An appointment reminder comprising, a cabinet means, a plurality of message storage means mounted in said cabinet means, comprising a plurality of paper strips mounted upon a message tray, a viewing window mounted in said cabinet means to permit viewing of said message storage means, a plurality of time selection means operably mounted in said cabinet means and disposed proximate each message storage means, provided with a timer switch, audio and visual indicating means operably mounted in said cabinet means, a plurality of message lighting means operably mounted in said cabinet means and disposed proximate each message, electric power supply means operably mounted in said cabinet means, a plurality of message activation switches operably mounted in said cabinet means, each of said message activation switches connected in series with a timer switch and also in series between said power supply and said message lights and said indicator means, override means comprising a switch and conductor means operably mounted in said cabinet means and connected in series between said power supply and all message lights simultaneously to view stored messages simultaneously.

* * * * *